US009052172B2

(12) United States Patent
Whitworth

(10) Patent No.: US 9,052,172 B2
(45) Date of Patent: Jun. 9, 2015

(54) FIREARM CLEANING SHELL

(71) Applicant: James Curtis Whitworth, Commerce Township, MI (US)

(72) Inventor: James Curtis Whitworth, Commerce Township, MI (US)

( * ) Notice: Subject to any disclaimer, the term of this patent is extended or adjusted under 35 U.S.C. 154(b) by 0 days.

(21) Appl. No.: 13/894,352

(22) Filed: May 14, 2013

(65) Prior Publication Data

US 2014/0109791 A1 Apr. 24, 2014

Related U.S. Application Data

(60) Provisional application No. 61/651,809, filed on May 25, 2012, provisional application No. 61/766,733, filed on Feb. 20, 2013.

(51) Int. Cl.

| | |
|---|---|
| ***F42B 14/04*** | (2006.01) |
| ***F42B 14/00*** | (2006.01) |
| ***F42B 5/24*** | (2006.01) |
| ***F42B 7/08*** | (2006.01) |

(52) U.S. Cl.

CPC ..... *F42B 14/04* (2013.01); *F42B 14/00* (2013.01); *F42B 5/24* (2013.01); *F42B 7/08* (2013.01)

(58) Field of Classification Search

CPC ..... F42B 5/24; F42B 14/00; F42B 14/04; F42B 7/08

USPC ..... 102/442, 511, 529; 42/95

See application file for complete search history.

(56) References Cited

U.S. PATENT DOCUMENTS

| | | | | |
|---|---|---|---|---|
| 938,836 | A | 11/1909 | Fessenden | |
| 1,039,774 | A * | 10/1912 | Melander | 102/511 |
| 1,231,227 | A | 6/1917 | Williams | |
| 1,495,008 | A * | 5/1924 | Feagin | 102/442 |
| 2,047,897 | A | 7/1936 | Symes | |
| 2,660,002 | A | 11/1953 | Farley | |
| 2,765,740 | A * | 10/1956 | Norman | 102/442 |
| 3,147,708 | A | 9/1964 | Ferguson | |
| 3,209,690 | A | 10/1965 | Mercatoris, Jr. | |
| 3,217,648 | A | 11/1965 | Foote et al. | |
| 3,285,174 | A | 11/1966 | Moehlman et al. | |
| 3,476,047 | A | 11/1969 | Davis | |
| 3,682,556 | A * | 8/1972 | Hanson | 401/132 |
| 3,740,883 | A | 6/1973 | Kyle | |
| 4,328,632 | A | 5/1982 | Beers | |
| 4,513,668 | A * | 4/1985 | Fuller | 102/511 |
| 4,843,750 | A | 7/1989 | Blase | |
| 4,998,368 | A | 3/1991 | Blase | |
| 5,164,539 | A * | 11/1992 | French | 102/520 |
| 5,233,128 | A * | 8/1993 | Lai | 102/511 |
| 5,341,744 | A | 8/1994 | Shi | |
| 5,777,258 | A | 7/1998 | Soon | |
| 5,970,878 | A | 10/1999 | Gardner | |
| 6,105,591 | A | 8/2000 | Decare et al. | |
| 6,389,978 | B1 | 5/2002 | Hooper et al. | |
| 7,131,381 | B1 | 11/2006 | Nafziger | |
| 7,150,229 | B2 | 12/2006 | Gardner | |

(Continued)

FOREIGN PATENT DOCUMENTS

RU 2293943 C2 2/2007

*Primary Examiner* — James S Bergin

(74) *Attorney, Agent, or Firm* — Vincent Re PLLC

(57) ABSTRACT

An apparatus including a bore cleaning projectile can be configured to clean a bore of a firearm as the projectile is propelled down the bore. The projectile includes a frame and a propellant providing a force to push the projectile down the bore of the firearm. The frame includes a collapsing feature that is actuated by the force provided by the propellant.

9 Claims, 6 Drawing Sheets

(56) References Cited

U.S. PATENT DOCUMENTS

| | | | |
|---|---|---|---|
| 7,451,707 | B1 | 11/2008 | Hadden |
| 7,707,942 | B1 | 5/2010 | Gardner |
| 7,743,706 | B1 | 6/2010 | Lai |
| 8,051,776 | B1 | 11/2011 | Bailey |
| 2002/0129725 | A1 | 9/2002 | Bice et al. |
| 2004/0244627 | A1 | 12/2004 | Bice et al. |

* cited by examiner

FIREARM CLEANING SHELL

CROSS REFERENCE TO RELATED APPLICATIONS

This disclosure claims the benefit of U.S. Provisional Application No. 61/651,809 filed on May 25, 2012 and U.S. Provisional Application No. 61/766,733 filed on Feb. 20, 2013 which are hereby incorporated by reference.

TECHNICAL FIELD

The present disclosure relates to a device for removing material such as carbon, lead, metals, and plastic contaminants from the bore of a firearm, and more particularly relates to a projectile having a frangible vessel containing a liquid cleaning solution, for example, a wet or dry abrasive cleaning agent, a stacked series of abrasive materials (brushes, scouring pads) and fibrous wadding which are concentrically mounted upon a frame which expands outwardly when compressed to force intimate contact of the abrasive materials and wadding against the firearm's bore.

BACKGROUND

The statements in this section merely provide background information related to the present disclosure. Accordingly, such statements are not intended to constitute an admission of prior art.

Cleaning the bore of a firearm after use is generally required to prevent possible damage due to corrosion to the bore. It is often true that the task of manually cleaning a firearm is most undesirable when the condition of the firearm is most suitable for bore damage; for example at the end of an outing under inclement conditions. The task of manually cleaning the bore of a firearm is time consuming and may require disassembly of the firearm. Therefore there is a need among users of firearms for a convenient, quick, easily used and effective device for cleaning a bore of moisture, powder residue and foreign material which contributes to the corrosion within a bore until a more complete manual cleaning may be accomplished.

Embodiments are known in the art to propel material down the barrel of a firearm to clean the bore of the gun. These devices, however, rely on compacted wadding to sufficiently wipe down the inner wall of the bore as they travel therethrough. To fit within a shell capable of being fired from a particular firearm inherently requires that the wadding and other materials be compacted to be smaller in rough diameter than the bore they are intended to clean. This results in an ineffectively cleaning of the bore as portions of the bore are not wiped by the intended cleaning components.

Further, these devices also generally comprise stacked layers of wadding and other materials which are either premoistened with a cleaner or lubricant which reduces the shelf life of product.

SUMMARY

An apparatus including a bore cleaning projectile can be configured to clean a bore of a firearm as the projectile is propelled down the bore. The projectile includes a frame and a propellant providing a force to push the projectile down the bore of the firearm. The frame includes a collapsing feature that is actuated by the force provided by the propellant.

BRIEF DESCRIPTION OF THE DRAWINGS

One or more embodiments will now be described, by way of example, with reference to the accompanying drawings, in which:

FIG. 2 is a perspective view of a frame portion of a cleaning projectile, in accordance with the present disclosure;

FIG. 3 is a perspective view of the frame portion with angular features expanding radially as they collapse and with a collapsing table feature, in accordance with the present disclosure;

FIG. 4 is an enlarged perspective view of the assembled cleaning projectile apart from the shell casing, in accordance with the present disclosure;

FIG. 5 is a cut-away view of the grouped collapsible legs of the frame, in accordance with the present disclosure;

FIG. 6 is a cut-away view of the radially inner surface of one collapsible frame leg, in accordance with the present disclosure;

FIG. 7 is a perspective view of the stacked scrubbing material portion of the projectile, in accordance with the present disclosure;

FIG. 8 is a top plan view of the scrubbing material portion, in accordance with the present disclosure;

DETAILED DESCRIPTION

Figure 1:
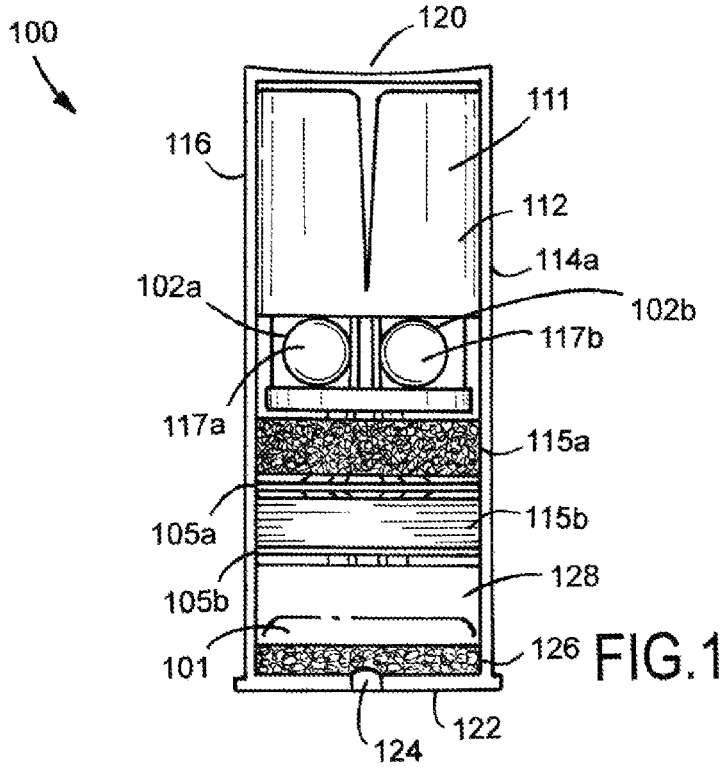
FIG. 1 illustrates an exemplary embodiment of a bore cleaning device for use in a shotgun, in accordance with the present disclosure.

Referring now to the drawings, wherein the showings are for the purpose of illustrating certain exemplary embodiments only and not for the purpose of limiting the same, a bore cleaning projectile can be used to wipe or scrub contaminants from the bore of a firearm. Contaminants in a bore can include gunpowder residue, lead or copper from bullets fired through the bore, brass shavings from shell casings, dirt or other intrusive contaminants, and/or corrosion within the bore caused by humidity interacting with the material of the firearm barrel. Scrubbing brushes and materials are known for use in cleaning out a bore, wherein the operator of the firearm disassembles the firearm and pushes or pulls cleaning materials through the bore. Cleaning solvents and/or lubricating liquids can be used to aid in the cleaning process.

Utilizing a projectile configured to clean contaminants from the bore of the firearm can be beneficial in that the projectile can be fired and the bore cleaned without the firearm being disassembled. Such a feature can be a convenience, saving time of the operator. Such a feature can increase the operating life of the firearm, as diassembling and reassembling the firearm can be a source of damage or wear upon the firearm. Such a feature can be lifesaving, for example, in combat, wherein the readiness of the soldier using the firearm can be put at risk if the firearm requires disassembly due to contamination.

Projectiles used to clean the bore of a firearm need to able to be loaded in to the firearm and cycled as would a normal round of ammunition. As a result, the projectile must fit within a shell casing typical to a round of ammunition, and the projectile must be shaped to easily slide out of the casing and into the bore of the firearm. However, such a projectile is inherently smaller than the caliber of the bore through which the projectile is being fired. As a result, interaction of the projectile with the bore can be less than desired. As a result, the scrubbing that needs to take place to effectively clean the bore can fail to take place.

A round of ammunition includes a propellant, which when activated, provides a quickly expanding gas that is used to propel a bullet down the bore. A cleaning projectile can utilize this expanding gas and the crushing force that is applied to the projectile as it is propelled down the bore to compensate or change the characteristics of the projectile such that the bore is effectively cleaned. The crushing force can be used to actuate a feature located to a frame of the cleaning projectile, for example, releasing a cleaning agent and/or expanding a diameter of the projectile, thereby changing how the projectile interacts with the bore.

FIG. 1 illustrates a bore cleaning device 100 for removing materials from the bore of a firearm, specifically including an exemplary shotgun. The device 100 includes a shotgun shell-shaped cleaning projectile 111 having an elongated frame 112, which housed within a shell or shell casing 114*a*. Frame 112 and casing 114*a* cooperate to retain a plurality of capsules 102*a* and 102*b*, the capsules including bore cleaning agents 117*a* and 117*b*, respectively, to afford removal of moisture, powder residue and foreign material via swift propulsion of the projectile 111 through the bore of a firearm. While cleaning agents 117*a* and 117*b* are illustrated, it will be appreciated that a plurality of capsules can be located spaced around frame 112. Cleaning agents 117*a* and 117*b* can include a liquid or a powder based cleaning agent. Further, cleaning agents 117*a* and 117*b* can include the same ingredients or different ingredients, for example, with some cleaning agent mixed with lubricating oil or an anti-corrosion agent such that the inner bore of the barrel can be simultaneously coated with a protective film at the same time the cleaning agent is applied. Such use of a lubricating oil with the cleaning agent, wherein the oil is flammable and could be ignited by ignition of a gunpowder charge, can in some embodiments be used with an embodiment wherein gunpowder is not used as the propellant for the projectile. Frame 112 and casing 114*a* can further retain one or more wiper devices, illustrated in FIG. 1 as wipers 105*a* and 105*b*. Wipers 105*a* and 105*b*, in one embodiment, can include polymer or rubberized disks that are configured to wipe along the inner diameter of the bore of the barrel, for example, as a windshield wiper wipes along the surface of a vehicular windshield. Lower charge cap 128 of projectile 111 is positioned and configured to receive force from an expanding gas from the propellant and transmit the force to the rest of projectile 111.

Typically, a firearm has a cartridge receiving chamber, an exit bore in the barrel of the firearm which communicates with the chamber, and a conventional firing mechanism for discharging cartridges within the chamber. It should be readily apparent to one skilled in the relevant art that shell casing 114*a* and other casings disclosed herein replicate traditional firearm projectiles (e.g., bullet or shotgun shell) and are sized to operably fit within the receiving chamber of a particular type of firearm (e.g., shotguns, handguns, rifles of various calibers and preferred shell configurations.) Firearms can include a firing pin configured to a centerfire cartridge or a rimfire cartridge. Projectiles disclosed herein can be configured to be activated by either firing pin configuration.

Particularly, the device 100 includes a shell casing 114*a* suitable for loading in the chamber of the firearm. The shell 114*a* can be of a conventional type and is formed with a hollow cylindrical wall member 116 defining a cylindrical cavity of generally the same diameter as the bore of the firearm in which the projectile 111 is configured to be used. The shell 114*a* has an open end 120 for exit of the projectile 111 and a closed end or base portion 122 at the opposite end thereof. The base portion 122 is formed with an orifice in which is mounted a primer mechanism 124 which initiates a chemical reaction within a propellant material 126, which results in a the rapid production of expanding gases within the cavity to propel the projectile 111 through the bore of the firearm. In one embodiment of the disclosure, the propellant material 126 includes at least two shelf stable materials which are separated until the primer mechanism 124 causes the charge material components to intermix resulting in the rapid production of expanding gases. In another non-limiting embodiment, a conventional firearm primer may initiate the chemical reaction within the propellant 126. In still other embodiments, the propellant 126 may be a small amount of clean burning gunpowder. In another non-limiting embodiment, a pressurized gas cartridge, such as a $CO_2$ cartridge could be used, with rapidly expanding gas from the cartridge acting as the propellant.

Figure 2:
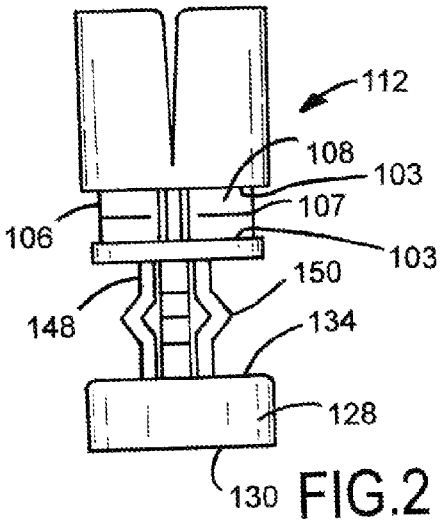
FIGS. 2-8 illustrate features of the exemplary embodiment of FIG. 1.
Figure 3:
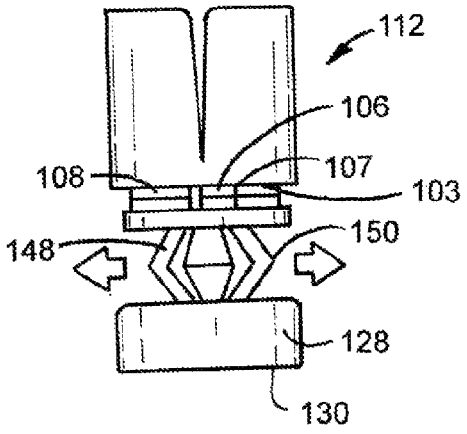
Figure 4:
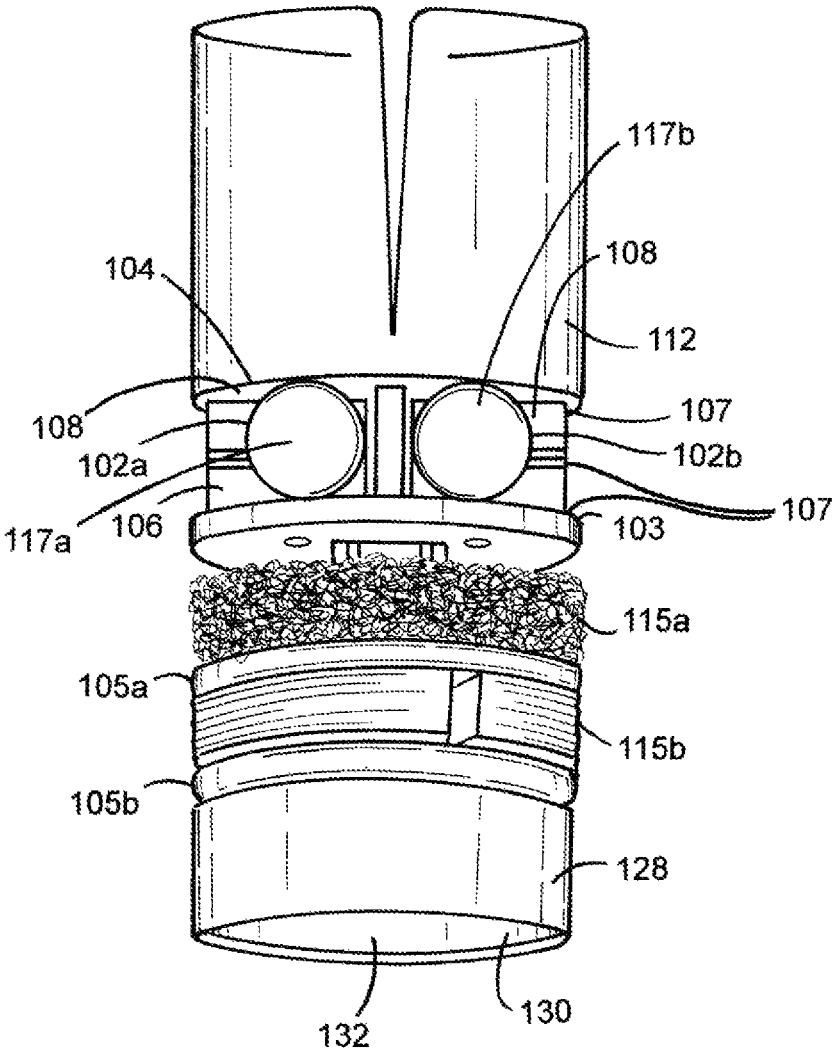

Referring to FIGS. 2, 3, and 4, the frame 112 includes a lower charge cap 128 having an annular open wall 130 which defines a charge cavity 132 that receives the propellant 126. In one embodiment, cavity 132 includes a concave surface. The upper end of cap 128 includes a circular base plate 134 which separates the cavity 132 and propellant 126 from the rest of the frame and to provide a seal to restrict the escape of gases through the projectile 111 from the propellant charge thereby ensuring that essentially all of the force from the rapidly expanding gases will be utilized to propel the projectile 111 through the bore of the firearm.

Cleaning agents 117*a* and 117*b* are each located in a frangible or easily breakable capsule 102*a* and 102*b*, respectively. Frame 112 includes a plurality of collapsible pockets 108 that are initially provided in an extended or open position such that pockets 108 can hold one of capsules 102*a* and 102*b*. One embodiment can utilize four exemplary six millimeter diameter capsules. The capsules, in one embodiment, can be similar in construction to paint balls used in recreational sport. Each pocket 108 includes vertical support walls 106 that each include a plurality of creases 107 or perforating features, such that vertical support walls 106 can be easily crushed or compressed, thereby enabling a collapsed position wherein capsules 102*a* and 102*b* are crushed between flat table surfaces 103 and 108 of frame 112. FIG. 2 illustrates frame 112 including pockets 108 in an open position. FIG. 3 illustrates frame 112 including pockets 108 in a collapsed position. Frame 112 is constructed such that the propelling force applied by propellant 126 to charge cavity 132 provide a longitudinal crushing force to frame 112 sufficient to transition pockets 108 from the open position to the collapsed position.

Scrubbing or wiping materials 115*a* and 115*b* and wipers 105*a* and 105*b* are illustrated installed to frame 112 about a plurality of vertical supports 148 running along a center of the frame 112. Each vertical support 148 includes at least one a crease or perforation enabling the vertical support 148 to predictably bend upon an application of crushing force to the frame 112. In the embodiment illustrated in FIGS. 2 and 3, each support 148 includes a angular feature 150 creating a predictable collapse of each support 148 in a direction of the angular feature. By arranging the angular features 150 to point radially outward from a center of frame 112, a crushing force applied to frame 112 can result in each of the supports 148 collapsing and projecting outward radially from a center of the frame. As a result, materials 115*a* and 115*b* and wipers 105*a* and 105*b*, initially occupying the area that the collapsing supports are being pushed into, are pushed outward and are caused to press against an inside surface or bore of the barrel as the projectile is being propelled down the full length of the bore. This pressing of the materials and wipers against the bore provides for intimate contact between the materials and wipers and the interior of the bore and provides improved cleaning of the bore while permitting the materials and wipers to initially fit within shell casing 114*a* prior to the supports 148 being collapsed.

Capsules 102*a* and 102*b* are located above materials 115*a* and 115*b* or are on the front end of the projectile and move through the bore prior to materials 115*a* and 115*b* moving through the bore. As a result, when the capsules are crushed and cleaning agents released, the cleaning agents will soak or wiped along by materials 115*a* and 115*b*, acting as a solvent and thereby improving the cleaning ability of the materials.

In one embodiment, the entire frame is formed from a rigid, yet readily machinable material, such as polyethylene or polyester plastic. In one embodiment, the frame is constructed of injection molded thermoplastics. In still other embodiment, a portion of the frame may be made from the same material as the bore scrubbing materials.

Figure 5:
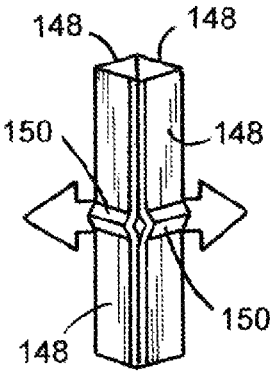
Figure 6:
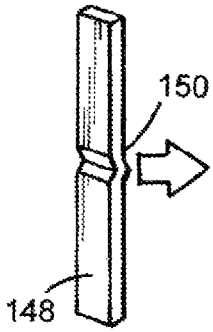

FIGS. 5 and 6 illustrate in detail operation of vertical supports 148 and angular features 150.

Figure 7:
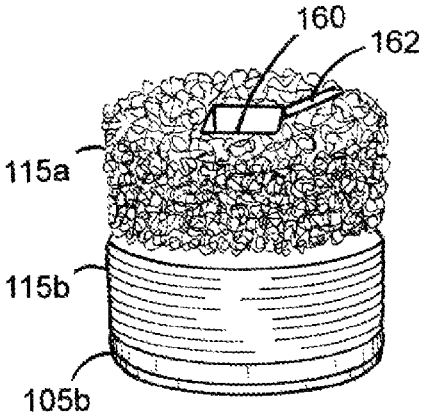

As shown in FIG. 7, each of the components of the scrubbing materials 115*a* and 115*b* include a central through bore 160 along with a radial passage 162. Bore 160 is sized to receive the collective legs 148 of the frame 112, while passage 162 allows for both assembly of the materials about the legs and to ensure that each materials are free to radially expand with the legs 148 when the frame 112 collapses upon itself.

Figure 8:
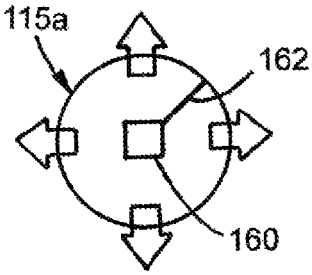

FIG. 8 illustrates material 115*a* including bore 160 and passage 162 in detail.

In addition to scrubbing materials and a wiping device being used to clear contaminants from a bore of a firearm, other structures can be utilized upon projectiles disclosed herein to clean the bore. For example, a brush with nylon, brass, or other bristles attached to the projectile and with ends in contact with the bore can be utilized to provide a scrubbing action in the rifling of the bore. As the projectile is propelled down the bore along the barrel, the bristles can be pushed along the rifling of the bore, with friction from the bristles knocking loose particles otherwise adhered to the wall of the bore. Such an embodiment can be useful in a rifled barrel, wherein the bore includes a spiral of grooves along the barrel. Contaminants can be situated within the grooves in the bore, such that a smooth wiping device passing along a top surface of the groove might fail to dislodge the contaminant adhered to a bottom surface of the groove. Bristles on a projectile, each being narrow, flexible, and capable of independent motion as compared to neighboring bristles, can extend into corners and recesses within the bore such as a rifling groove, such that the brush can provide improved cleaning action.

Figure 9:
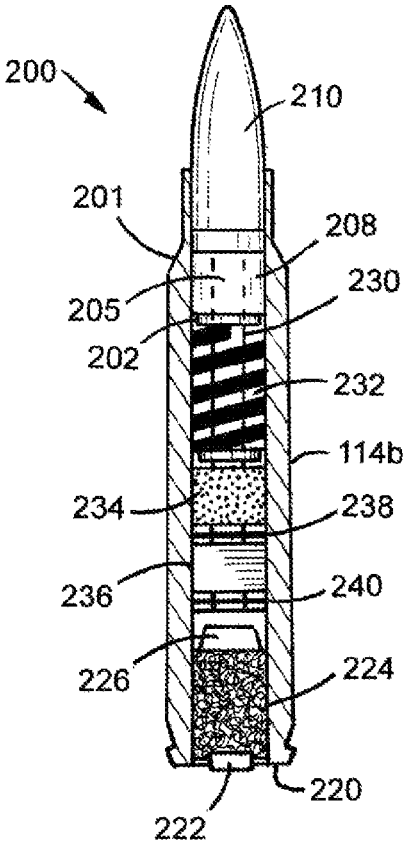
FIG. 9 illustrates an exemplary additional embodiment of a bore cleaning device for use in a long rifle, in accordance with the present disclosure.

Referring now to FIG. 9, another embodiment of the device is illustrated including an exemplary .223 Remington® shell casing 114*b*. While a .223 shell is provided for illustration, it will be appreciated that any rifle cartridge, handgun cartridge, shotgun shell, or any other similar ammunition style can be equipped according to the cleaning shells disclosed herein. Configuration 200 includes casing 114*b* with a bullet cap 210 installed thereto. A particular firearm can require that a shell have a particular shape profile to feed correctly from a magazine into the chamber. Bullet cap 210 in combination with shell casing 114*b* can provide a shell with a standardized shape such that the shell can be loaded in a magazine, the action of the firearm cycled, and the shell loaded into the chamber as a normal round of ammunition would be. Bullet cap 210 can include a lead or similar bullet. In another embodiment, bullet cap 210 can be a rubber bullet. In another embodiment, a copper, plastic, or other polymer bullet cap can be utilized. Casing 114*b* includes a base portion 220 including a primer 222 and a propellant 224. Concussion cap 226 is provided with a dome center. Configuration 200 includes projectile 205 including structures to clean the inside of a bore of a firearm. Projectile 205 can include a frame including a center shaft 230. Brush 232 is illustrated connected to center shaft 230. Brush 232 includes bristles constructed of brass, nylon, or any other materials known in the art for scrubbing the interior of a bore or rifling on the interior of a bore. Scrubbing materials 234 and 236 and wiper devices 238 and 240 are further illustrated assembled to center shaft 230. As the primer is struck by the firing pin of the firearm, the propellant is ignited and rapidly expands providing a propelling force to the projectile 205 and the bullet cap 210. A frangible capsule 208 configured as a hollow cylindrical vessel is illustrated configured to center shaft 230. Center shaft 230 can include a collapsible feature to enable crushing of the capsule 208 according to methods disclosed herein. In another embodiment, ridges, grooves, or other features can be installed to the center shaft 230, casing 114*b*, or to some other feature of configuration 200 to enable or promote the crushing of capsule 208 to provide for release of the cleaning agent included therewithin. As projectile 205 is propelled through the length of the barrel, the brush 232 scours the interior of the bore and rifling therein.

Shell casing 114*b* can be constructed of brass or other similar materials according to methods known in the art. Rifle shell casings typically include wide sections in the area wherein gunpowder is encased, with the rifle shell necking down to capture and hold a smaller diameter bullet. Such a neck down section on a rifle shell can pose a challenge for a cleaning projectile as disclosed herein. The projectile needs to be aligned with the hole of the shell casing, such that the cleaning projectile can easily exit the casing and enter the bore. Further, the projectile must seal adequately within the casing such that the expanding gas of the propellant does not just pass around the projectile. An exemplary shell casing enabling use of a cleaning projectile in a rifle round can include a common cross section throughout the casing. Brass casings typically have a uniform wall thickness. In one embodiment, shell casing 114*b* can be constructed of a plastic or other polymer. According to one embodiment, a high density polymer can be used, wherein the polymer is selected for properties enabling high resistance to detonation or a blast associated with the propellant within the shell. An example of a high density polymers are illustrated in new technologies found in Lightweight Polymer Cased Ammunitions, for example, offered by the PCP Ammunition Company in Orlando, Fla. In such a shell casing, the walls of the casing can be constructed with varying cross-section. Casing 114*b* is illustrated with a varying cross section, such that a contoured outer surface 201 can be provided in combination with a uniform or nearly uniform cylindrical interior 202 to the shell casing. Such a cylindrical interior 202 can securely hold projectile 205 in place and permit the projectile to smoothly exit the interior 202. Casing 114*b* constructed with a polymer permitting cylindrical interior 202 can include a transition to a brass or other material for base portion 220 in order to strengthen the base portion and permit it to securely withstand the force of the ignition and expansion of the propellant. Other solutions to the necked down section of a rifle round are envisioned. For example, a shell casing can be machined out of a solid bar of brass, steel, or other material to include the desired outer contours of the rifle round casing and the uniform cross section within the casing.

Figure 10:
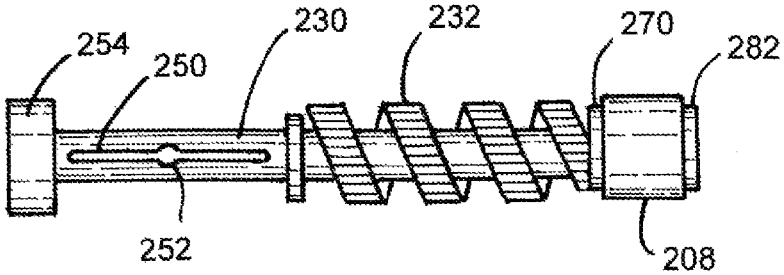
FIG. 10 illustrates an exemplary center shaft of the bore cleaning device of FIG. 9, in accordance with the present disclosure.

FIG. 10 illustrates an exemplary center shaft for the embodiment of FIG. 9 including a cylindrical frangible capsule. Center shaft 230 is illustrated including a brush 232 and a cylindrical capsule 208. Center shaft 230 can include a feature permitting the center shaft to collapse or flex, permitting an outward or radial force to be applied to materials or wiping device assembled to the shaft, thereby pushing the materials or devices against the bore of the firearm. Feature 250 is illustrated including a slot configured down the length of the center shaft 230. Feature 250 is illustrated including a through-hole feature 252. A crushing or propelling force applied to lower charge cap 254 of center shaft 230 will compress the center shaft 230 and tend to cause the center shaft to flex outward at feature 250, the two halves of the shaft acting as collapsing vertical supports, each pushing outward upon any object or objects positioned to the center shaft in that area, with an apex of the flex occurring at through-hole feature 252. In one embodiment, center shaft 230 can alternatively include knee-shaped angular sections as disclosed herein. The flexing of shaft 230 is similar to two opposing vertical supports 148 flexing at angular feature 150 illustrated in FIGS. 2 and 3.

Cylindrical capsule 208 is configured to break based upon the projectile being propelled down the bore. In one embodiment, the high friction between capsule 208 and interaction with the rifling in the bore can consistently rupture the capsule and release the cleaning agent therein. In another embodiment, center shaft 230 between cap plates 270 and 282 can be configured to crush based upon the force being applied to the projectile, thereby crushing capsule 208 between plates 270 and 282.

Figure 11:
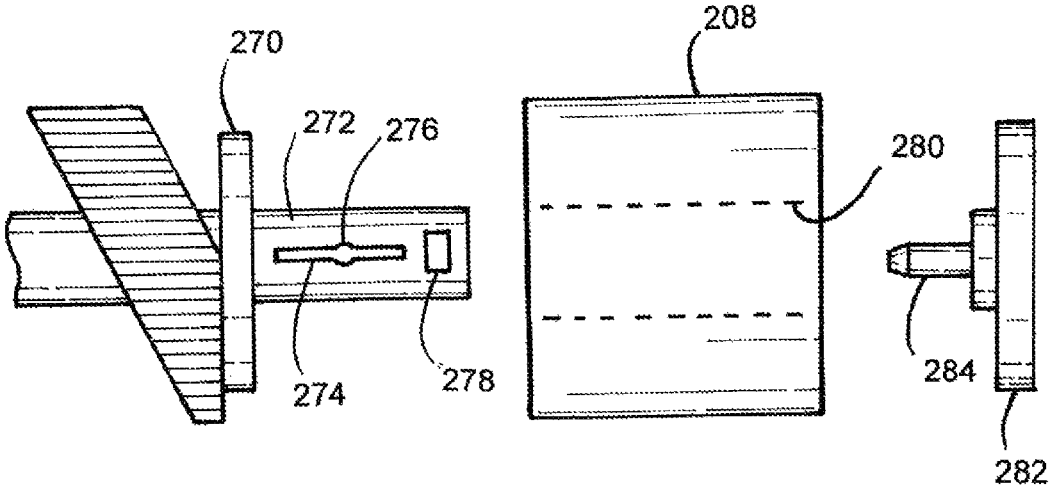
FIG. 11 illustrates exemplary attachment of a capsule to the center shaft of FIG. 10, in accordance with the present disclosure.

FIG. 11 illustrates exemplary attachment of a capsule to the center shaft of FIG. 10. Capsule 208 is illustrated removed from the center shaft, such that portion 272 of the shaft is exposed. Capsule 208 includes inner diameter 280 configured to accept portion 272. In one embodiment, an end cap or plate such as 282 can be configured to slide along shaft 272 and crush capsule 208. In the illustrated embodiment, portion 272 can include a feature enabling the shaft to collapse when a crushing force is applied to the projectile, for example, including slot 274 and through hole 276. When portion 272 collapses, capsule 208 expands and is ripped open by the rifling in the bore and/or can be crushed between plates 270 and 282. For assembly purposes, plate 282 is illustrated including a snap feature 284 configured to be pushed into mating feature 278, thereby securing plate 282 to portion 272. The collapsing features of portion 272 and the attachment features securing plate 282 to portion 272 are non-limiting examples of how the features of the projectile can be configured.

Figure 12:
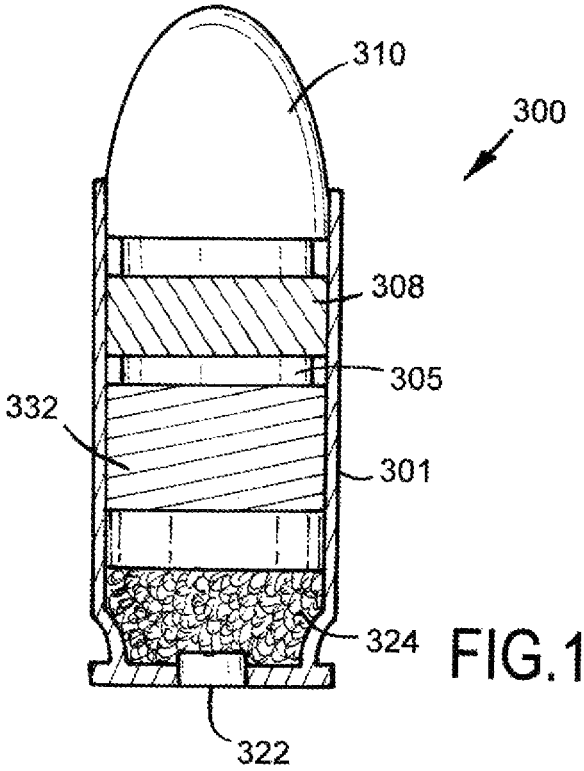
FIG. 12 illustrates an exemplary additional embodiment of a bore cleaning device for use in a handgun, in accordance with the present disclosure.

FIG. 12 illustrates an exemplary additional embodiment of a bore cleaning device for use in a handgun. Bore cleaning device 300 is illustrated including an exemplary .45 automatic Colt® pistol (ACP) shell casing 301. While a .45 shell is provided for illustration, it will be appreciated that any rifle cartridge, handgun cartridge, shotgun shell, or any other similar ammunition style can be equipped according to the cleaning shells disclosed herein. Use of a bore cleaning device in a handgun rounds such as a .45 ACP, 9 mm, .44 cal. magnum, or .38 special pose a challenge as compared to a rifle round such as the exemplary .223 round in that the length of the handgun round can be significantly shorter than a rifle round. As a result, a cleaning projectile located between the bullet and the propellant charge is going to be shorter than a cleaning projectile used in a rifle round. Device 300 includes shell casing 301, bullet 310, primer 322, propellant charge 324. Cleaning projectile 305 is illustrated within casing 301, including a frangible capsule area 308 and a cleansing material/scrubbing/wiping area 332. Frangible capsule area 308 can include a round frangible capsule, a plurality of round frangible capsules, a cylindrically-shaped frangible capsule or any other type of capsule known in the art. The capsule or capsules can be crushed by a collapsing frame of projectile 305 as disclosed herein, or the capsule or capsules can be configured to rupture based upon interaction with the rifling of the bore through which projectile 305 is propelled. Cleansing material/scrubbing/wiping area 332 can include cleansing materials, cloth pads, wiper devices, brushes, or any other materials known in the art for cleaning the bore of a firearm.

Figure 13:
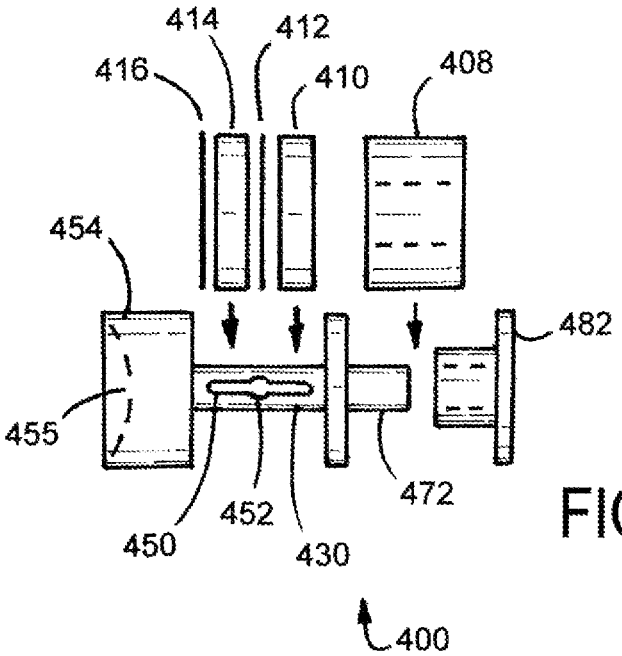
FIG. 13 illustrates an exemplary cleaning projectile of the bore cleaning device of FIG. 12, in accordance with the present disclosure.

FIG. 13 illustrates an exemplary cleaning projectile of the bore cleaning device of FIG. 12. Cleaning projectile 400 is provided as an exemplary embodiment of cleaning projectile 305 of FIG. 12 and includes a center shaft 430, lower charge cap 454, and end plate 482. Lower charge cap 454 is illustrated including a concave-shaped depression 455. Exemplary center shaft 430 includes a slot 450 and through hole 452 enabling the center shaft to collapse when a crushing force is applied to projectile 400. The collapsing sections of shaft 430 act as the vertical supports described above, providing an outward force on any object or objects positioned to center shaft 430 in that area. Cleansing material 410, a first wiper device 412, a cloth material 414, and a second wiper device 416 are illustrated for installation to projectile 400. End plate 482 includes a center diameter post that is configured to slidingly install to portion 472 of shaft 430, such that the end plate 482 can move along the portion 472, such that a crushing force applied to projectile 400 can cause end plate 482 to crush a frangible capsule or capsules located close to end plate 482. Cylindrically-shaped frangible capsule 408 is illustrated for installation to portion 472.

Figure 14:
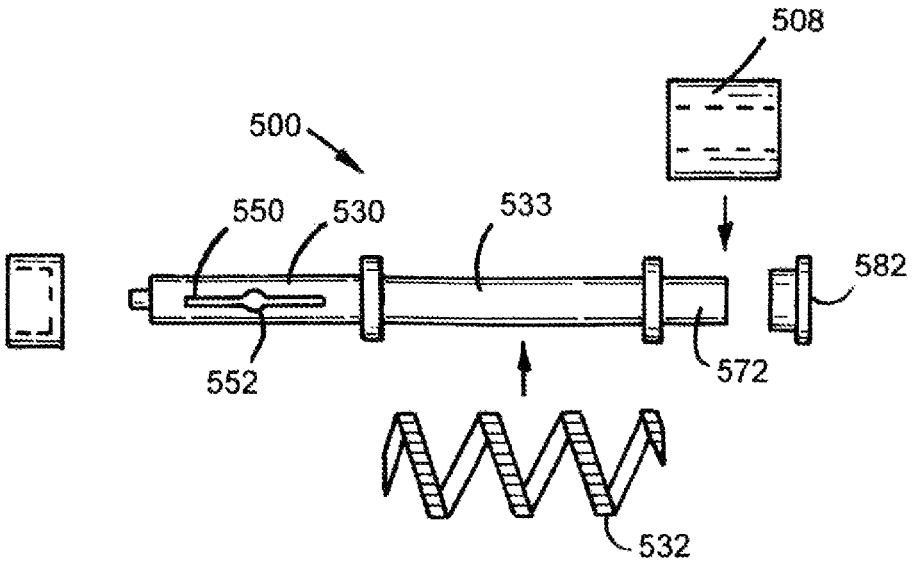
FIG. 14 illustrates an alternative exemplary center shaft for a cleaning projectile, in accordance with the present disclosure.

FIG. 14 illustrates an alternative exemplary center shaft for a cleaning projectile. Configuration 500 includes center shaft 530 that can be used in an exemplary cleaning device for a long rifle, such as is illustrated in FIG. 9. Center shaft 530 is illustrated including a polymer helical brush 532 which is constructed as a single piece that can be flexed and assembled to portion 533 of shaft 530. Brush 532 can include raised bumps along the outer surface that interacts with the bore, the raised bumps scraping along the bore and interacting with the rifling of the bore. Configuration 500 further includes a cylindrical frangible capsule 508 including a cleaning agent. Center shaft 530 can include a feature permitting the center shaft to collapse or flex, permitting an outward or radial force to be applied to materials or wiping device assembled to the shaft, thereby pushing the materials or devices against the bore of the firearm. Feature 550 is illustrated including a slot configured down the length of the center shaft 530. Feature 550 is illustrated including a through-hole feature 552. A crushing or propelling force applied to lower charge cap of center shaft 530, illustrated to the left of center shaft 530, will compress the center shaft 530 and tend to cause the center shaft to flex outward at feature 550, the two halves of the shaft acting as collapsing vertical supports, each pushing outward upon any object or objects positioned to the center shaft in that area, with an apex of the flex occurring at through-hole feature 552. Configuration 500 includes end cap 582 configured to fit on and slide along shaft portion 572, such that, when the projectile is propelled down the bore, end cap 582 will compress and crush capsule 508.

Figure 15:
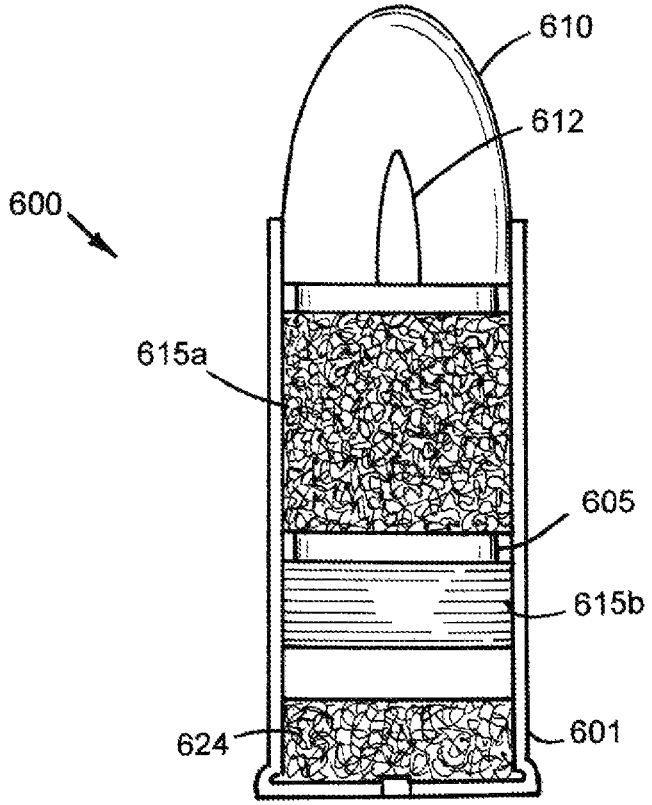
FIG. 15 illustrates an alternative exemplary embodiment of a bore cleaning device, in accordance with the present disclosure.

FIG. 15 illustrates an alternative exemplary embodiment of a bore cleaning device. Bore cleaning device 600 is illustrated including an exemplary .22 shell casing 601. Device 600 further includes bullet 610 and propellant charge 624. Cleaning projectile 605 is illustrated within casing 601, including cleansing materials 615*a* and cloth pad materials 615*b*. Bullet 610 can be constructed of or impregnated with a powdered cleaning agent or agents, such that the bullet moving through the bore deposits the cleaning agent through the bore. According to one embodiment, bullet 610 is configured to initially remain intact, providing initial back pressure to crush projectile 605, and then crush or pulverize as the bullet passes down the bore. Feature 612 includes an optional gap in the bullet 610, configured to encourage the bullet to break up and deposit the cleaning agent through the length of the bore.

Capsules disclosed herein can include cleaning agents or lubricating agents. Such capsules can be used in tandem, both to clean and to lubricate the bore of the firearm. An exemplary bore cleaning agent can include the BC-10 formula from Gunzilla®. An exemplary lubricating agent can include Rem® Oil from Remington®. Agents or oils that have a high petroleum content can be poor choices to use in capsules as disclosed herein, as some capsule materials break down over time after exposure to the petroleum content.

Bore cleaning devices disclosed herein can include a shell encapsulating propellant and a projectile as disclosed herein. The shell can additionally include a bullet, buckshot, or other projectile initially fastened or located to the end of the shell, wherein the bullet or other object is propelled down the bore in front of the cleaning projectile. In embodiments of the device wherein speed of the cleaning projectile firing at a highest possible speed is desired, no bullet or a lighter than usual object can be propelled in front of the cleaning projectile. However, wherein force must be utilized to crush or collapse a portion of the frame of the cleaning projectile, a bullet or other object with significant mass can be used to provide back pressure upon the cleaning projectile, increasing a proportion of the force of the propellant that is applied to crush the frame of the cleaning projectile. The device and any packaging used with the cleaning device can include a warning to avoid any misperception by the user, warning that use of the device does cause objects to fire at high speeds from firearm and that care typical to operation of a firearm must be taken.

Having thus described the present disclosure with reference to the embodiments illustrated in the drawing, it will be appreciated that other minor modifications may be made in the size or shape of the casing or projectile without departing from the present disclosure.

A device for cleaning the bore of a firearm can include frangible capsules that are crushed by actuation of a frame within a projectile, and the device can further include vertical supports within the frame that collapse and provide an outward force upon scrubbing and/or wiping members, forcing intimate contact between the members and the bore. The device can alternatively include either frangible capsules that are crushed by actuation of a frame within a projectile or vertical supports within the frame that collapse and provide an outward force upon scrubbing and/or wiping members, and the disclosure is not intended to be limited to a device including both of the provided embodiments. Further, force applied to the base of the projectile can otherwise cause deformation or collapse of portions of the projectile, thereby aiding in the projectile effectively cleaning the bore of the firearm, and the disclosure is not intended to be limited to the particular examples of deformation to the frame provided herein.

Cleaning agents acting as a solvent can work very rapidly, quickly dissolving contaminants within the bore of the firearm. However, a solvent can more completely dissolve contaminants if applied to a bore and permitted to stay in the bore for a time before being wiped away. Further, it can be beneficial to leave a film of oil or lubricating agent in a bore after the bore is cleaned and the firearm is being put away for a time, thereby preventing moisture in the air from corroding the bore over time. According to one embodiment of the disclosure, a plurality of devices can be used to sequentially perform distinct operations in the bore. For example, a first device could be discharged within the chamber of the firearm, including frangible capsules dispersing solvent through the bore of the firearm. Such a device could optionally include a lightly packed scrubbing material, not including sufficient contact to wipe the solvent from the bore, but instead contributing to evenly spreading the solvent within the bore. A second device could be used after a time with scrubbing and/or wiping materials including collapsing vertical supports and/or a brush device for physically scraping contaminants from the bore and wiping the solvent from the bore. Such a second device could optionally include a powdered cleaning agent upon one or more of the scrubbing materials for added cleaning. A third device could be used, with frangible capsules including a lubricating agent for coating the bore. Different devices could optimally include propellants with different forces applied to the projectile depending upon the role of the device. The different embodiments of the devices could be used in a number of envisioned processes, for example, with only the second device being used in the middle of a shooting activity to lightly clean the firearm, and with the sequence of the three devices being used at the end of the shooting activity, preparing the firearm to be put away for a time. Special bore cleaning devices with particular compositions and cleansing materials can be provided and marketed to particular uses, for example, particularly configured for clay shooting, duck hunting, or military applications, these particular users have particular concerns about the functioning of their firearms. A number of processes are envisioned, and the disclosure is not intended to be limited to the examples provided herein.

In one embodiment, a chemical combination can include a mix of chemicals selected to break down deposits and leave a thin film of the bore surface to prevent future collection of debris, sand, or other contaminants.

A bore cleaning device could be configured for use in a military application, for example, wherein a chain of ammunition for use in an automatic weapon could include one bore cleaning device every one hundred or two hundred rounds, thereby preventing contaminants from building up in the bore of the firearm through extended use.

Methods disclosed herein include providing a projectile for a firearm including cleaning features attached to the projectile, wherein the projectile is encapsulated within a shell, and wherein activating a propellant within the shell causes 1) the projectile to be pushed down a bore of the firearm and 2) a crushing force applied upon the projectile to cause activation of the cleaning features. The crushing force can cause one or both of crushing a table feature or collapsing of support legs, wherein the collapsing support legs are configured to apply a radially outward force upon cleaning materials, the outward force causing intimate contact between the materials and the surface of the bore. A method to provide a bore cleaning projectile to a bore of a firearm can include providing a projectile including a frame and a scrubbing material assembled to the frame, wherein the frame includes a collapsing feature that transforms a crushing force applied to the frame by an exploding propellant into a radially outward force upon the scrubbing material. Another method to provide a bore cleaning projectile to a bore of a firearm can include providing a projectile including a frame and a frangible capsule containing a cleaning agent, wherein the frame utilizes a crushing force applied to the frame by an exploding propellant to crush the capsule and release the cleaning agent.

The disclosure has described certain embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a bore cleaning projectile configured to clean a bore of a firearm comprising:

the projectile comprising a frame;

a propellant providing a force to push the projectile down the bore of the firearm;

a frangible capsule containing a cleaning agent; and a scrubbing material that wipes along the bore as the projectile is pushed down the bore;

wherein the frame comprises a collapsing feature that is actuated by the force provided by the propellant;

wherein the collapsing feature breaks the frangible capsule; and wherein the collapsing feature comprises a vertical support configured to collapse and force intimate contact between the scrubbing material and the bore.

2. The apparatus of claim 1, wherein the cleaning agent comprises a liquid cleaning agent.

3. The apparatus of claim 1, wherein the cleaning agent comprises a powder cleaning agent.

4. The apparatus of claim 1, further comprising a second frangible capsule containing a lubricating agent.

5. The apparatus of claim 1, wherein the projectile further comprises a polymer wiper that wipes along the bore as the projectile is pushed down the bore.

6. The apparatus of claim 1, wherein the projectile is configured to operate within a shotgun.

7. The apparatus of claim 1, further comprising a plurality of frangible capsules, each capsule containing a cleaning agent;

wherein the cleaning agent within a first portion of the frangible capsules comprises a liquid cleaning agent;

wherein the cleaning agent within a second portion of the frangible capsules comprises a powdered cleaning agent; and wherein the collapsing feature breaks the frangible capsules.

8. The apparatus of claim 1, wherein the vertical support comprises an angled section configured to push outward as the vertical support collapses.

9. The apparatus of claim 1, wherein the vertical support comprises an indentation configured to enable the vertical support to bend at the indentation as the vertical support collapses.

* * * * *